United States Patent [19]

Smith

[11] 3,962,500

[45] June 8, 1976

[54] PROCESS FOR TREATING FIBERS

[75] Inventor: Charles Smith, Barry, Wales

[73] Assignee: Dow Corning Limited, Barry, Wales

[22] Filed: Dec. 12, 1974

[21] Appl. No.: 531,943

[30] Foreign Application Priority Data

Dec. 18, 1973 United Kingdom..... 58604/73
Oct. 22, 1974 United Kingdom..... 45727/74

[52] U.S. Cl...... 427/387; 260/825; 260/46.5 Y; 428/266; 428/447

[51] Int. Cl.[2]..... C08L 83/08

[58] Field of Search ..... 260/825, 46.5; 428/266, 428/447; 427/387

[56] References Cited

UNITED STATES PATENTS

| | | | |
|---|---|---|---|
| 3,418,162 | 12/1968 | Adachi | 260/825 X |
| 3,436,251 | 4/1969 | Rees | 260/825 X |
| 3,532,766 | 10/1970 | Leyshon et al. | 260/825 |
| 3,799,919 | 3/1974 | Gibbon | 260/825 X |
| 3,849,359 | 11/1974 | Nitzsche et al. | 428/447 X |

FOREIGN PATENTS OR APPLICATIONS

| | | | |
|---|---|---|---|
| 1,111,156 | 4/1968 | United Kingdom | 260/825 |

*Primary Examiner*—Ralph S. Kendall
*Attorney, Agent, or Firm*—Robert F. Fleming, Jr.

[57] ABSTRACT

Method for imparting resilience and crease resistance to synthetic fibers, particularly knitted fabrics, by applying to the fibers a composition obtained by mixing a hydroxylated polydiorganosiloxane, an organosilane having amino and alkoxy or alkoxyalkoxy groups in the molecule and an organosilane having alkoxy or alkoxyalkoxy groups and hydrogen atoms, monovalent hydrocarbon or halogenated hydrocarbon groups in the molecule. Partial hydrolysates of the silanes may optionally be used. The applied composition is then cured at normal or elevated temperatures.

15 Claims, No Drawings

PROCESS FOR TREATING FIBERS

This invention relates to a process for the treatment of textile fibres.

It is known to treat textile fibres, particularly cotton and synthetics, with organopolysiloxanes and compositions containing organopolysiloxanes to impart thereto properties such as water repellency and lubricity. Whilst the achievement of such properties is now commercially well established there has been a continuing effort towards endowing synthetic fibres with other desirable properties. For example, there has existed a desire to improve the resilience of synthetic fibres; this property being related to the ability of the fibres to return to their original appearance or dimensions after crushing or stretching. Any improvement in resiliency is therefore to be desired as it increases the resistance of synthetic fabrics to wrinkling and also imparts springiness and bounce. Although known organopolysiloxane textile treatments have resulted in an improvement in the resilience of synthetic fabrics such improvement has generally been of a low order. In addition the effect has not been durable to laundering or dry cleaning.

We have now found that a significant improvement in the resiliency of synthetic fibres can be obtained by treatment of the fibres, either per se or as blends with cellulosic fibres, with a certain type of organopolysiloxane composition. We have also found that the improvement in resiliency obtained is retained to a substantial extent even after the treated fibres have been subjected to laundering or dry cleaning.

Accordingly this invention provides a process for the treatment of synthetic fibres which comprises applying thereto a composition comprising the product obtained by mixing (A) a polydiorganosiloxane having terminal silicon-bonded hydroxyl radicals and a molecular weight of at least 750, at least 50 per cent of the organic substituents in the polydiorganosiloxane being methyl radicals, any other organic substituents present being monovalent hydrocarbon radicals having from 2 to 30 carbon atoms, (B) an organosilane of the general formula $RSiR'_aX_{3-a}$ wherein R represents a monovalent radical composed of carbon, hydrogen, nitrogen and, optionally, oxygen which radical contains at least two amine groups and is attached to silicon through a silicon to carbon linkage, R′ represents an alkyl radical or an aryl radical, each X represents an alkoxy or alkoxyalkoxy radical having from 1 to 14 inclusive carbon atoms, and $a$ is 0 or 1, and/or a partial hydrolysate of said organosilane and (C) a silane having the general formula $R''_bSiZ_{4-b}$, wherein R″ is a hydrogen atom, a monovalent hydrocarbon radical or a monovalent halogenated hydrocarbon radical, Z is an alkoxy or alkoxyalkoxy radical having from 1 to 4 inclusive carbon atoms and $b$ is 0 or 1, and/or a partial hydrolysate of said silane, and thereafter curing the applied composition.

The polydiorganosiloxanes (A) are linear or substantially linear siloxane polymers having terminal silicon-bonded hydroxyl radicals. Such polydiorganosiloxanes have about two, that is from about 1.9 to 2, organic radicals per silicon atom and methods for their preparation are well known in the art. The polydiorganosiloxanes should have an average molecular weight of at least 750, preferably from 20,000 to 90,000.

At least 50 per cent of the silicon-bonded organic substituents in the polydiorganosiloxane are methyl, any other substituents being monovalent hydrocarbon radicals having from 2 to 30 carbon atoms, for example, alkyl and cycloalkyl radicals, e.g. ethyl, propyl, butyl, n-octyl, tetradecyl, octadecyl and cyclohexyl, alkenyl radicals e.g. vinyl and allyl and aryl, aralkyl and alkaryl radicals e.g. phenyl, tolyl and benzyl. A small proportion of hydroxyl radicals may be attached to non-terminal silicon atoms in the polydiorganosiloxane. However, such non-terminal hydroxyl radicals should preferably not exceed about 5% of the total substituents in the polydiorganosiloxane. The preferred polydiorganosiloxanes are the polydimethylsiloxanes i.e. those represented by the formula

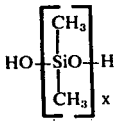

in which $x$ is an integer, preferably having a value such that the polydiorganosiloxane has a viscosity of from 100 to 50,000 cS at 25°C.

Component (B) of the compositions employed in the process of this invention is an organosilane of the general formula $RSiR'_aX_{3-a}$ wherein R, R′, X and $a$ are as defined hereinabove, and/or it may be a partial hydrolysate of said organosilane. Such organosilanes are known substances and they may be prepared as described, for example, in U.K. Pat. Nos. 858,445 and 1,017,257. In the general formula of the organosilanes the radical R is composed of carbon, hydrogen, nitrogen and, optionally, oxygen and contains at least two amine (which term includes imine) groups. It is attached to silicon through a silicon to carbon linkage, there being preferably a bridge of at least 3 carbon atoms separating the silicon atom and the nearest nitrogen atom or atoms. Preferably also, R contains less than about 21 carbon atoms and any oxygen is present in carbonyl and/or ether groups. Examples of the operative R substituents are $-(CH_2)_3NHCH_2CH_2NH_2$, $-(CH_2)_4NHCH_2CH_2NHCH_3$, $-CH_2.CH.CH_3CH_2NHCH_2CH_2NH_2$, $-(CH_2)_3NHCH_2CH_2NHCH_2CH_2NH_2$, $$-(CH_2)_3NHCH_2CH_2\overset{\overset{\displaystyle CH_2CH_2NH_2}{|}}{C}H(CH_2)_3NH_2 \text{ and } (CH_2)_3NH(CH_2)_2NHCH_2CH_2COOCH_3.$$

Each of the X substituents may be an alkoxy or alkoxyalkoxy radical having from 1 to 14 carbon atoms, preferably from 1 to 4 carbon atoms. Examples of X radicals are methoxy, iso-propoxy, hexoxy, decyloxy and methoxyethoxy. When present R′ may be any alkyl or aryl radical, preferably having less than 19 carbon atoms, e.g. methyl, ethyl, propyl, octyl or phenyl. Preferred as component (B) are the organosilanes wherein R represents the $-(CH_2)_3NHCH_2CH_2NH_2$ or the $-CH_2CHCH_3CH_2NHCH_2CH_2NH_2$ radicals, each X represents an alkoxy radical having from 1 to 4 inclusive carbon atoms and R′, when present, represents the methyl radical.

As component (C) there are employed silanes of the general formula $R''_bSiZ_{4-b}$ wherein R″, Z and *b* are as defined hereinabove, or partial hydrolysates of said silanes. In the general formula of the silanes (C) R″ may be a hydrogen atom or a monovalent hydrocarbon radical or halogenated hydrocarbon radical, for example alkyl, e.g. methyl, ethyl, propyl, butyl, hexyl, decyl, octadecyl, alkenyl e.g. vinyl or allyl, aryl, aralkyl or alkaryl e.g. phenyl, tolyl or benzyl, halogenoalkyl, e.g. chloromethyl, bromoethyl or 3,3,3-trifluoropropyl and halogenoaryl e.g. chlorophenyl. The radical Z may be for example methoxy, ethoxy, propoxy or methoxyethoxy. Preferably Z is methoxy or ethoxy and R″, when present, is methyl. Examples of the silanes (C) and their partial hydrolysis products are methyltrimethoxysilane, ethyltrimethoxysilane, n-propyltriethoxysilane, phenyltriethoxysilane, tetraethyl orthosilicate, n-butyl orthosilicate, ethyl polysilicate and siloxanes containing both silicon-bonded methyl radicals and methoxy radicals. It will be understood by those skilled in the art that reference to partial hydrolysis products with regard to the silane components (B) and (C) contemplates also those products where condensation involving hydrolysed radicals has taken place to yield siloxane linkages.

According to a preferred embodiment of this invention the compositions employed to treat synthetic fibres also contain a siloxane condensation catalyst (D) which is a metal organic compound. We have found that the presence of said catalyst (D) can result in a further improvement in the resiliency and other desirable properties of the treated fibres.

A variety of organic metal compounds are known which are capable of functioning as siloxane condensation catalysts (D). The best known and preferred for use in the process of this invention are the metal carboxylates, for example lead 2-ethyl-hexoate, zinc octoate, cobalt naphthenate, stannous octoate, stannous naphthenate, dibutyltin dilaurate, din-octyl tin diacetate and dibutyltin diacetate. Particularly preferred are the tin carboxylates. Other metal organic compounds which may be employed include the titanium and zirconium esters and chelates e.g. tetrabutyl titanate, tetraisopropyl titanate and diisopropoxytitanium di(ethylacetoacetate), diorganotin alkoxides e.g. dibutyltin diethoxide and dioctyltin dimethoxide and the diacylpolydiorganostannoxanes e.g. diacetoxytetraalkyldistannoxane.

The compositions employed in the process of this invention may be applied to the synthetic fibres using any suitable application technique, for example by padding or spraying. The level of application of the composition to the fabric may be varied within wide limits. From about 0.1 to 7 per cent by weight of composition based on the weight of the fibres represents the preferred application level. Higher proportions of applied composition, for example up to 40% by weight based on the weight of fibres, can be employed. However, such high application levels are in most cases economically unattractive.

From considerations of bath stability and convenience of application the compositions of the invention are best applied in the form of a dispersion or solution in a liquid carrier, for example as an aqueous emulsion or organic solvent solution. Preferably the compositions are applied from a solution or dispersion in an organic solvent. Solvents which may be employed include the hydrocarbons and chlorinated hydrocarbons, for example one or more of toluene, xylene, benzene, white spirit, perchloroethylene and trichloroethylene. Suitable solvents or combinations of solvents will be readily apparent to those skilled in the art.

If desired the bath life of the compositions can be extended by incorporating with the composition a compound containing at least one hydroxyl radical attached to an aliphatic carbon atom. Suitable hydroxylated compounds include organic compounds and polymers, for example, alkanols e.g. n-hexyl alcohol, octyl alcohol and nonyl alcohol, glycols and polyglycols and their monoethers e.g. ethylene glycol, polyethylene glycol, ethylene glycol monobutyl ether, diethylene glycol monohexyl ether, mixed polyethylene-polypropylene glycols and condensation products of ethylene oxide with polyhydroxyl compounds such as glycerol. The hydroxy radical(s) may also be attached to an organic portion which is in turn attached to an organosilicon portion, for example as in siloxane-oxyalkylene block copolymers. When present the hydroxylated compound is preferably employed in a proportion of from 1 to 15%, most preferably from 2 to 8%, by weight based on the combined weight of (A), (B) and (C).

Following application to the fibres the applied organopolysiloxane composition is cured. Cure of the composition may be effected by merely exposing the treated fibres to the atmosphere at normal atmospheric temperatures (about 15° – 25°C). Although such a procedure may be acceptable in the case of batch processes, curing is preferably expedited (especially in continuous processes) by exposure to elevated temperatures e.g. from 110° – 180°C. Where appropriate, or desired, curing may be preceded by a drying step at a lower temperature.

The relative proportions of the components (A), (B), (C) and (D) present in the compositions are not narrowly critical. Preferably from 0.5 to 15 parts by weight of (B), 1 to 20 parts by weight of (C) and 0.5 to 10 parts by weight of (D) are employed per 100 parts of (A). Higher proportions of (B), for example up to 25 parts by weight can be present but increasing the proportion of (B) results in the treated fibres having a firmer, crisper handle. Higher proportions of (C) and (D) may also be employed, for example up to 25 parts of (C) and up to 15 parts of (D).

The process of this invention can be employed in the treatment of synthetic fibres alone, for example, nylon, polyester and acrylic fibres, blends of synthetic fibres of different types or blends of synthetic fibres and cellulosic fibres. The fibres may be treated in any form where resilience is desired, for example as agglomerations or random fibres, as knitted fabrics or as woven fabrics. The process of this invention is particularly suitable for the treatment of knitted fabrics.

In addition to possessing increased resilience, fibres treated according to this invention may also exhibit desirable improvements in other properties. Thus increased resiliency will normally be accompanied by an improvement in one or more of, for example, abrasion resistance, handle, tear strength, reduction of snagging in knitted fabrics and resistance to melting by hot particles.

The following Examples illustrate the invention. In the Examples the properties of the treated fibres were measured by the following methods.

Tear Resistance

5 Samples 63.5 mm. × 100 mm. in size were cut in the length and in the width of the fabric. Each test sample was placed on an Elmendorf Tester, with a 20.5 mm. cut made with a sharp knife in the centre of the test piece at right angles to its longer side. The sample was then pulled lengthwise and the tension (gm.) observed at which tearing occurred.

Crease-recovery rate

5 Samples 15 mm. × 40 mm. were cut in the length and in the width of the fabric. Each test sample was folded into two so that the longer side is halved. The samples were then placed between two glass plates and allowed to stand for 5 minutes with a 500 g. load on the upper plate. The weight and upper plate were removed and the opening angle $\alpha$ of the test piece measured with a crease-recovery tester.

$$\text{Crease recovery rate } \% = \frac{\alpha}{180} \times 100$$

Resilience recovery rate

Samples of treated fabric (20 cm. × 4 cm.) were subjected to 50% elongation along the length and width of the fabric in turn. The elongating load was then relaxed and the length of the sample ($L^2$) measured after 5 seconds. The resilience recovery rate was calculated as $$\frac{2L^1 - L^2}{L^1} \times 100$$

wherein $L^1$ is the original length of the sample.

Hand

The hand of the fabric was assessed by touch.

EXAMPLE 1

A composition was prepared by mixing by weight

| | |
|---|---|
| Polydimethylsiloxane having terminal ≡ SiOH groups and M.Wt. = 45000 (3000cS at 25°C) | 90 parts |

-continued

| | |
|---|---|
| *Partial condensate of $CH_3Si(OCH_3)_3$ | 10 parts |

*Prepared by refluxing the silane with aqueous sodium hydroxide solution (0.25% by weight NaOH) for 3 hours.

Fifteen parts by weight of the composition was dissolved in 1000 parts of perchloroethylene and to this solution were added with stirring 2 parts of $(CH_3O)_3Si(CH_2)_3NHCH_2CH_2NH_2$ and 3 parts of a 50% by weight solution in xylene of dibutyltin dioctoate. The resulting solution was then employed to treat by padding samples of knitted fabric, the fibres consisting of a blend of polyester fibres (65%) and cotton fibres (35%). The impregnated fabrics were then dried at about 90°C and heated for 3 minutes at 150°C to cure the applied composition. The weight of cured composition on the fabric (add on) was 3.5% based on the weight of the untreated fabric.

The properties of the treated samples and of control (untreated) samples were then measured by the methods described above. The results obtained were as follows:

| Sample | Crease Recovery Rate (%) | | Tear Resistance | | Hand |
|---|---|---|---|---|---|
| | Wale | Course | Wale | Course | |
| Control (untreated) | 29.3 | 36 | 670 | 520 | No flexibility - rather hard |
| Treated | 88.5 | 92.0 | 901 | 782 | Soft and springy. |

EXAMPLE 2

A composition was prepared by dissolving the following in 1000 parts of perchloroethylene.

| | |
|---|---|
| Hydroxylated-polydimethylsiloxane (as Example 1) | 12 parts |
| $(CH_3O)_3Si(CH_2)_3NHCH_2CH_2NH_2$ | 1 part |
| Partial condensate of $CH_3Si(OCH_3)_3$ | 0.2 part |
| Dibutyltin dioctoate | 0.6 part |

the parts being expressed by weight.

The composition so obtained was employed to treat knitted polyester (100%) fabric by padding to give a composition pick-up of 220% by weight based on fabric weight. The treated fabric was then dried at 80°C and heated for 5 minutes at 130°C to cure the siloxane.

When the properties of the treated and untreated fabrics were measured as described above the following results were obtained.

| | Crease Recovery Rate (%) | | Resilience Recovery Rate (%) | | Hand |
|---|---|---|---|---|---|
| | Wale | Course | Wale | Course | |
| Untreated | 43.0 | 87.5 | 62.5 | 78.4 | Lifeless and rather hard. |
| Treated | 93.9 | 91.6 | 100 | 98.9 | Soft and springy |

EXAMPLE 3

A composition was prepared by dissolving the following in 5000 parts of perchloroethylene;

| | |
|---|---|
| Hydroxylated polydimethysiloxane (As Example 1) | 68 parts |
| $(CH_3O)_3Si(CH_2)_3NHCH_2CH_2NH_2$ | 4.8 parts |
| Partial condensate of $CH_3Si(OCH_3)_3$ | 1.2 parts |

the parts being expressed by weight.

The composition thus obtained was employed to treat samples of blue nylon tricot knitted fabric by padding to give a composition pick up of 220% by weight based on fabric weight. After drying at 80°C for 3 minutes the fabric samples were heated at 130°C for 3 minutes to cure the siloxane.

When the properties of the treated and untreated samples were measured as described above the following results were obtained.

| | Crease Recovery Rate (%) | | Hand |
|---|---|---|---|
| | Wale | Course | |
| Treated | 76 | 95.5 | Slippery, soft and slightly springy. |
| Untreated | 58 | 96 | Very limp. |

That which is claimed is:

1. A process for the treatment of synthetic fibres which comprises applying thereto a composition consisting essentially of the product obtained by mixing (A) 100 parts by weight of a polydiorganosiloxane having terminal silicon-bonded hydroxyl radicals and a molecular weight of at least 750, at least 50 per cent of the organic substituents in the polydiorganosiloxane being methyl radicals, any other organic substituents present being monovalent hydrocarbon radicals having from 2 to 30 carbon atoms, (B) from 0.5 to 15 parts by weight of an organosilicon compound selected from the group consisting of organosilanes having the general formula $RSiR'_aX_{3-a}$ wherein R represents a monovalent radical composed of carbon, hydrogen, nitrogen and, optionally, oxygen which radical contains at least two amine groups and is attached to silicon through a silicon to carbon linkage, R′ represents an alkyl radical or an aryl radical, each X represents an alkoxy or alkoxyalkoxy radical having from 1 to 14 inclusive carbon atoms, and *a* is 0 or 1, and partial hydrolysates of said organosilanes and (C) from 1 to 20 parts by weight of an organosilicon compound selected from the group consisting of silanes having the general formula $R''_bSiZ_{4-b}$, wherein R″ is a hydrogen atom, a monovalent hydrocarbon radical or monovalent halogenated hydrocarbon radical, Z is an alkoxy or alkoxyalkoxy radical having from 1 to 4 inclusive carbon atoms and *b* is 0 or 1 and partial hydrolysates of said silanes, and thereafter curing the applied composition whereby the resiliency of the synthetic fibres is improved.

2. A process as claimed in claim 1 wherein the polydiorganosiloxane (A) is a polydimethylsiloxane having a viscosity at 25°C within the range from 100 to 50,000 cS.

3. A process as claimed in claim 1 wherein in the general formula of organosilane (B) R represents the $-(CH_2)_3NHCH_2CH_2NH_2$ or $-CH_2CHCH_3CH_2NHCH_2CH_2NH_2$ radicals, each X represents an alkoxy radical having from 1 to 4 carbon atoms and R′, when present, represents the methyl radical.

4. A process as claimed in claim 1 wherein in the general formula of (C) each Z represents a methoxy or ethoxy radical and R″ when present represents the methyl radical.

5. A process as claimed in claim 1 wherein the composition is applied as a dispersion or solution in a volatile organic solvent.

6. A process as claimed in claim 1 wherein the composition comprises from 0.5 to 15 parts by weight of (B) and 1 to 20 parts by weight of (C) per 100 parts by weight of (A).

7. A process as claimed in claim 1 wherein the composition also contains a compound having at least one hydroxyl radical attached to an aliphatic carbon atom.

8. A process as claimed in claim 7 wherein the hydroxylated compound is present in a proportion of from 2 to 8% by weight based on the total weight of (A), (B) and (C).

9. A process for the treatment of synthetic fibres which comprises applying thereto a composition consisting essentially of the product obtained by mixing (A) 100 parts by weight of a polydiorganosiloxane having terminal silicon-bonded hydroxyl radicals and a molecular weight of at least 750, at least 50 per cent of the organic substituents in the polydiorganosiloxane being methyl radicals, any other organic substituents present being monovalent hydrocarbon radicals having from 2 to 30 carbon atoms, (B) from 0.5 to 15 parts by weight of an organosilicon compound selected from the group consisting of organosilanes having the general formula $RSiR'_aX_{3-a}$ wherein R represents a monovalent radical composed of carbon, hydrogen, nitrogen and, optionally, oxygen which radical contains at least two amine groups and is attached to silicon through a silicon to carbon linkage, R′ represents an alkyl radical or an aryl radical, each X represents an alkoxy or alkoxyalkoxy radical having from 1 to 14 inclusive carbon atoms, and *a* is 0 or 1, and partial hydrolysates of said organosilanes, (C) from 1 to 20 parts by weight of an organosilicon compound selected from the group consisting of silanes having the general formula $R''_bSiZ_{4-b}$, wherein R″ is a hydrogen atom, a monovalent hydrocarbon radical or monovalent halogenated hydrocarbon radical, Z is an alkoxy or alkoxyalkoxy radical having from 1 to 4 inclusive carbon atoms and *b* is 0 or 1 and partial hydrolysates of said silanes and (D) from 0.5 to 10 parts by weight of a siloxane condensation catalyst which is a metal organic compound, and thereafter curing the applied composition whereby the resiliency of the synthetic fibres is improved.

10. A process as claimed in claim 9 wherein the polydiorganosiloxane (A) is a polydimethylsiloxane having a viscosity at 25°C within the range from 100 to 50,000 cS.

11. A process as claimed in claim 9 wherein R represents the $-(CH_2)_3NHCH_2CH_2NH_2$ or $-CH_2CHCH_3CH_2NHCH_2CH_2NH_2$ radicals, each X represents an alkoxy radical having from 1 to 4 carbon atoms and R′, when present, represents the methyl radical.

12. A process as claimed in claim 11 wherein the composition is applied as a dispersion or solution in a volatile organic solvent.

13. A process as claimed in claim 9 wherein the metal organic compound is a tin carboxylate.

14. A process as claimed in claim 9 wherein there is also incorporated into the composition a compound having at least one hydroxyl radical attached to an aliphatic carbon atom.

15. A process as claimed in claim 14 wherein the hydroxylated compound is present in a proportion of from 2 to 8% by weight based on the total weight of (A), (B) and (C).

* * * * *